United States Patent [19]

Hipp, Jr.

[11] 4,395,032

[45] Jul. 26, 1983

[54] DOCUMENT FEEDER

[75] Inventor: Richard D. Hipp, Jr., Rushseba Township, Chisago County, Minn.

[73] Assignee: Minnesota Mining and Manufacturing Company, Saint Paul, Minn.

[21] Appl. No.: 241,765

[22] Filed: Mar. 9, 1981

[51] Int. Cl.[3] ..... B65H 5/00

[52] U.S. Cl. ..... 271/10; 271/34; 271/117; 271/251

[58] Field of Search ..... 271/34, 35, 109, 10, 271/117, 251; 226/179, 180

[56] References Cited

U.S. PATENT DOCUMENTS

| | | | |
|---|---|---|---|
| 694,039 | 2/1902 | Sturtevant | 271/34 |
| 2,461,376 | 2/1949 | Feldmeier | 226/180 X |
| 3,021,136 | 2/1962 | Fox | 271/34 X |
| 3,266,799 | 8/1966 | Ingalls . | |
| 3,750,924 | 8/1973 | Pepper | 226/180 X |
| 3,945,636 | 3/1976 | Kockler | 271/251 X |

*Primary Examiner*—Richard A. Schacher

*Attorney, Agent, or Firm*—Cruzan Alexander; Donald M. Sell; David W. Anderson

[57] ABSTRACT

A document feeder having multiple feed members biased into contact with a document to be fed which members are mounted in a manner affording their independent angular adjustment with respect to each other and with respect to the document path, and affording an equalization of the total bias force exerted against the document amongst each of the feed members.

12 Claims, 4 Drawing Figures

DOCUMENT FEEDER

FIELD OF THE INVENTION

This invention relates to a document feeder utilizing multiple and spaced feed members to transport a document along a defined path within a document processing machine.

BACKGROUND OF THE INVENTION

To ensure the correct processing of the information contained on a document, it is important that the position of the document be accurately controlled as the document is transported or advanced along a processing path within a copy machine or other document processing machine. Greater control can be achieved over the positioning of the document if multiple feed members are spaced across the path, and positioned to afford multiple areas of contact with the document. If however, the multiple feed members are not aligned with each other as well as with the processing path, the unequal forces exerted on the document by the unaligned feed members may tend to bow the document between the feed members, tear the document between the feed members, or skew the document toward one side of the processing path.

SUMMARY OF THE INVENTION

The present invention is directed to a document feeder including multiple feed members which are mounted in a manner facilitating their independent angular adjustment with respect to each other and to the processing path, and facilitating a balancing of the pressure exerted by each of the feed members on the document to be fed. The document feeder according to this invention comprises a first and a second feed member mounted within a frame and positioned adjacent opposite sides of a document processing path defined within the frame. Means are provided to bias each of the feed members into contact with a document which is to be fed, in a manner balancing the total pressure or biasing force exerted against the document, equally between the feed members. Typically the feed members are rollers or drive belts which when rotated urge the document, along the processing path, in the direction of their rotation at the point of contact. To afford the alignment of these multiple feed members with each other and with the document processing path and thereby minimize any bowing, tearing, or skewing of the documents, the present invention also includes lever means for pivotally mounting each of the feed members and for affording the independent angular adjustment of each of the feed members with respect to the adjacent side of the path and with respect to each other. This is accomplished by supporting each of the feed members on a separate lever which includes a first arm extending generally parallel to the adjacent side of the path. The first arm has an aperture therethrough which is disposed toward one of its ends. A shaft which is mounted on the frame of the document feeder generally transverse to the path, passes through the aperture and therefore serves as a fulcrum for the lever. Means are provided for adjusting the angular relationship of the first arm and the shaft. As the angular relationship is adjusted, the lever pivots about the shaft, changing the angular orientation of the feed member supported thereon with respect to the processing path.

DESCRIPTION OF THE DRAWING

The present invention will be further described hereinafter with reference to the accompanying drawing wherein.

DETAILED DESCRIPTION

Figure 1:
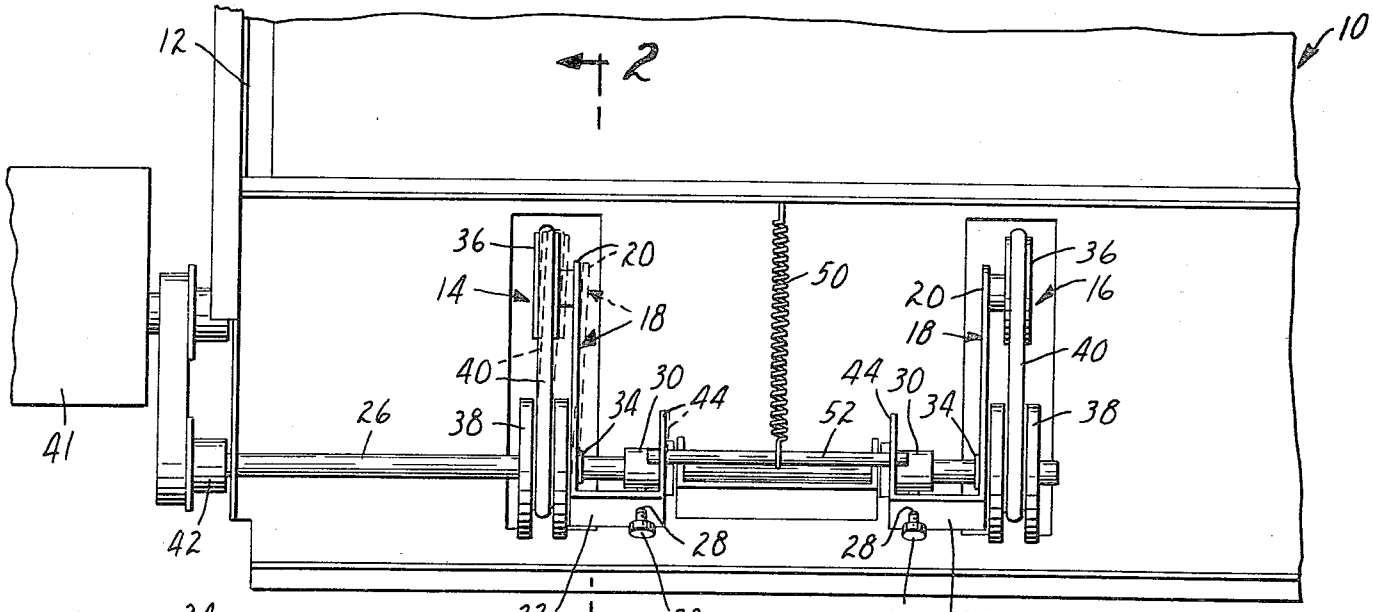
FIG. 1 is a top view of the document feeder according to the present invention.
Figure 3:
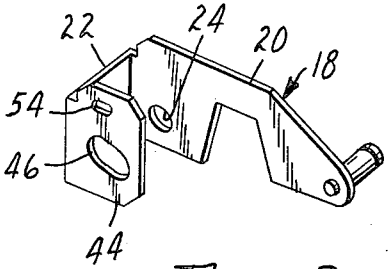
FIG. 3 is a perspective view of the bracket included in the present invention.
Figure 2A:
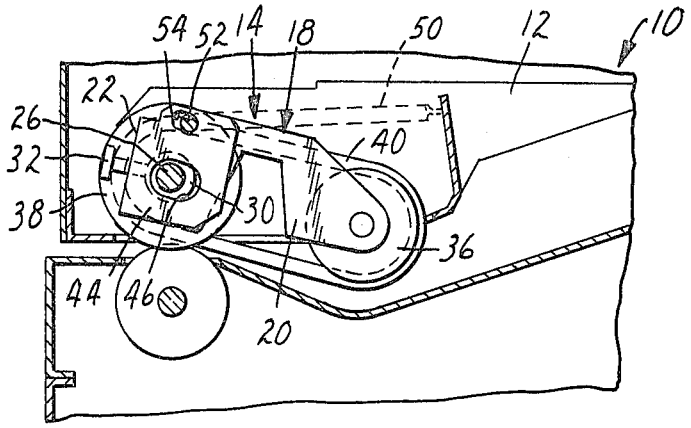
FIGS. 2*a* and FIG. 2*b* are transverse sections taken along line 2—2 of FIG. 1.
Figure 2B:
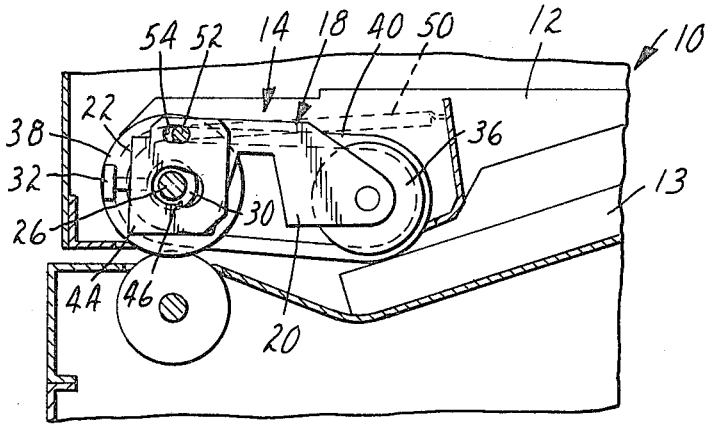

A document feeder 10, according to the present invention, is illustrated in FIG. 1. This document feeder 10 includes a frame 12 upon which a document or a stack of documents 13 (see FIG. 2*b*) is supported, for advancement along a processing path defined within the feeder 10. A first feed member 14 is mounted on the frame 12 adjacent a first side of the document processing path, and a second feed member 16 is mounted on the frame 12 adjacent a second side of the path. These feed members 14 and 16 are pivotally mounted on the frame 12 in a manner affording their independent angular adjustment with respect to each other and to the adjacent side of the document path. Each of the feed members 14 and 16 can therefore be accurately aligned with each other and oriented to advance the document along the processing path without bowing, tearing, or skewing the document with respect to the path. The independent angular adjustment of the feed members 14 and 16 is made possible by individually mounting each of them on a lever 18 (see FIG. 3) including a first arm 20 which extends generally parallel to the adjacent side of the path, and a second arm 22 which projects at an angle from one end of the first arm 20. Adjacent the end of the first arm 20 from which the second arm 22 projects the lever 18 has an aperture 24 penetrating therethrough. This aperture 24 is adapted to receive a shaft 26 which is mounted on the frame 12 above and generally transverse to the processing path. This shaft 26 extends generally along the second arm 22 of the bracket 18. The aperture 24 and the shaft 26 are sized to afford the pivotal movement of the bracket 18 about the shaft 26. Thus the shaft 26 serves as a fulcrum for the lever 18. The ease in which the bracket 18 pivots with respect to the shaft 26 is enhanced by the presence of a sleeve 34 rotatably mounted on the shaft 26. The aperture 24 of the lever 18 is adapted to receive this sleeve 34, and the sleeve 34 is made of a low friction material allowing the shaft 26 to turn within the sleeve 34 and the bracket 18 to slide along the sleeve 34. The aperture 24 is large enough, therefore, to accommodate the change in the angular orientation of the lever 18 as the first arm 20 is pivoted. The second arm 22 (see FIG. 1) also includes a bore 28 passing therethrough leading toward the shaft 26. A second sleeve 30 is rotatably mounted on the shaft 26 and is positioned adjacent the bore 28. The bore 28 has an internal thread which is adapted to mate with an external thread on a screw 32 which passes through the bore 28 and engages the thread therein. This screw 32 has a sufficient length to contact the second sleeve 30, whereby the screw 32 can be adjusted to establish the distance between the shaft 26 and the distal end of the second arm 22. Any variance in this distance between the shaft 26 and the distal end of the second arm 22 pivots the lever 18 about the aperture 24, thereby changing the angular orientation of the first arm 20 with respect to the document path. Since the feed members 14 and 16 are supported on the respective levers 18, the changing of the angular orientation of the first arms 20 will pivot the feed members 14 and 16. This pivotal motion allows the alignment of each of the feed members with the other, as well as with the document path. Thus, for example, in the case of a rotating feed member, the angle of the feed member's axis of rotation with respect to the path is altered. As will be discussed, a spring 50 biases the second arm 22 toward the shaft 26 thereby maintaining contact between the screw 32 and the shaft 26, thus ensuring that the lever 18 is pivoted to the furthest position allowed by the screw 32.

Although many types of feed members are known within the art, the preferred embodiment utilizes a feed member comprising a pulley 36 which is rotatably mounted adjacent a distal end of the first arm 20. This pulley 36 is engaged by drive means which privide its rotation. The drive means include a drive wheel 38 mounted on the shaft 26 (which is rotatably mounted on the frame 12), and a belt 40 which connects the pulley 36 and the drive wheel 38. The shaft 26 is driven by mechanical means 41 within the office machine which engage a first drive pulley 42 affixed to the shaft 26.

In the preferred embodiment the lever 18 includes a third arm 44 which extends at an angle from the distal end of the second arm 22 which is opposite the first arm 20. This third arm 44 has a first slot 46 therethrough which is also adapted to receive the shaft 26. The first slot 46 is disposed within the third arm 44 such that its longitudinal axis lies in a plane parallel to that in which the feed member 14 or 16 is to pivot. Since the third arm 44 is spaced from the aperture 24 about which the lever 18 pivots, the opening therethrough for the shaft 26 must be elongated to accommodate the pivotal movement of the lever. The width of the first slot 46, however, remains narrow enough to furnish support for the lever 18 on the shaft 26, thereby providing rigidity for the feed members 14 or 16.

Each of the levers 18 move independently but are biased against the document which is to be fed, by a single spring 50 having one end fastened to the frame 12 and the other end fastened to a rod 52. The rod 52 is adapted to slideably engage a second slot 54 also located within the third arm 44 of the lever 18. This second slot 54 has its longitudinal axis parallel to the longitudinal axis of the first slot 46 but is spaced from the first slot 46 in a direction away from the document path. This spacing affords the application of torque by the spring 50 tending to rotate the lever 18 about the shaft 26, thus biasing the feed members 14 and 16 toward the frame 12 and against the document. The side walls of the second slot 54 supports the rod 52, while the spaced ends permits the pivotal movement of each of levers 18 with only a minimal effect on the biasing force exerted on the lever 18 by the spring 50. Hence, the levers 18 are equally biased against the document by a single spring 50. This effectively equalizes the force applied by each of the feed members 14 and 16 against the document. This spring 50 also maintains tension on the adjustment screws 32, thereby ensuring that the lever 18 is pivoted as far as the screw 32 allows.

Having thus described a preferred embodiment of the present invention, it will be understood that changes may be made in size, shape, or configuration of some of the parts without deparing from the present invention as described in the appended claims.

What is claimed is:

1. A document feeder for advancing a document along a defined path within an office machine comprising, frame means for supporting the document, a first document feed member positioned adjacent a first side of the path, and rotatably mounted on said frame means to urge the document along the path, a second document feed member positioned adjacent a second side of the path, and rotatably mounted on said frame means to urge the document along the path, lever means individually and pivotally supporting each of said feed members on said frame means, for affording the independent angular adjustment of each of said feed members with respect to the adjacent side of the path, so as to align each of the feed members with respect to each other and with respect to the document path, and means for biasing said feed members into contact with the document including a single spring connected between said frame means and both of said lever means so that said spring simultaneously biases each of said feed members into contact with the document with substantially equal force.

2. A document feeder according to claim 1 wherein said lever means comprises:

a shaft mounted within said frame means generally transverse to the path, a first arm extending generally parallel to the adjacent side of the path, said first arm having an aperture therethrough disposed toward one of its ends, said first arm being pivotally mounted on said shaft with said shaft passing through said aperture and thereby serving as a fulcrum for said first arm, means for adjusting the angular relationship between said first arm and said shaft, to pivot said first arm about said fulcrum and changing the angular orientation of said feed member supported on said lever means with respect to the path.

3. A document feeder according to claim 2 wherein said means for adjusting the angular separation between said first arm and said shaft comprises:

said lever means having a second arm projecting at an angle from said first arm and disposed generally parallel to said shaft, said second arm having a bore therethrough leading toward said shaft, said bore having an internal thread, a sleeve rotatably mounted on said shaft and positioned adjacent said bore, a screw passing through said bore and engaging said thread, said screw having sufficient length to contact said sleeve, whereby said screw can be adjusted to vary the angular relationship between said shaft and said second arm to pivot said first arm about said shaft.

4. A document feeder according to claim 2 wherein a sleeve is rotatably mounted on said shaft, and wherein said aperture within said first arm is adapted to receive said sleeve in a manner affording the sliding of said first arm upon said sleeve.

5. A document feeder according to claim 2 wherein each of said feed members comprises a pulley rotatably mounted adjacent the distal end of said first arm and drive means for rotating said pulley.

6. A document feeder according to claim 5 wherein said drive means includes, a drive wheel mounted on said shaft and wherein said shaft is rotatably mounted on said frame means, a belt connecting said pulley and said drive wheel, and an external drive rotating said shaft.

7. A document feeder according to claim 1 further comprising a rod extending between said lever means and wherein said spring is connected between said frame means and said rod at substantially the midpoint of the extension of said rod between said lever means so that substantially equal forces are exerted by said spring on each of said lever means.

8. A document feeder for advancing a document along a defined path within an office machine comprising:

frame means for supporting the document, a first document feed member positioned adjacent a first side of the path, and rotatably mounted on said frame means to urge the document along the path, a second document feed member positioned adjacent a second side of the path, and rotatably mounted on said frame means to urge the document along the path, a lever means pivotally supporting each of said feed members on said frame means for affording the independent angular adjustment of each of said feed members with respect to the adjacent side of the path and including:

a shaft mounted within said frame means generally transverse to the path, a first arm extending generally parallel to the adjacent side of the path, said first arm having an aperture therethrough disposed toward one of its ends, said first arm being pivotally mounted on said shaft with said shaft passing through said aperture and thereby serving as a fulcrum for said first arm, a second arm projecting at an angle from said first arm and disposed generally parallel to said shaft, a third arm extending at an angle from said second arm, said third arm having a first slot therethrough disposed with its longitudinal axis lying in a plane parallel to the plane in which said feed member is to pivot and adapted to receive said shaft, and a second slot with its longitudinal axis parallel to the longitudinal axis of said first slot, said second slot being spaced from said first slot in a direction away from the document path, means for adjusting the angular separation between said first arm and said shaft, thereby pivoting said first arm about said fulcrum and changing the angular orientation of said feed member with respect to the path, and means for biasing said feed members into contact with the document including a rod adapted to slideably engage said second slots of said third arms, and a spring connected between said rod and said frame means, whereby said rod can slide within said second slots to permit the independent angular adjustment of each of said lever means and yet afford the separate biasing of each of said lever means toward the document.

9. A document feeder according to claim 8 wherein said means for adjusting the angular separation between said first arm and said shaft comprises:

a bore having an internal thread through said second arm, a sleeve rotatably mounted on said shaft and positioned adjacent said bore, and a screw passing through said bore and engaging said thread, said screw having sufficient length to contact said sleeve, whereby said screw can be adjusted to vary the angular separation between said shaft and said second arm thereby pivoting said first arm about said shaft.

10. A document feeder according to claim 8 wherein a sleeve is rotatably mounted on said shaft, and wherein said aperture within said first arm is adapted to receive said sleeve in a manner affording the sliding of said first arm upon said sleeve.

11. A document feeder according to claim 8 wherein each of said feed members comprises a pulley rotatably mounted adjacent the distal end of said first arm and drive means for rotating said pulley.

12. A document feeder according to claim 11 wherein said drive means further includes:

a drive wheel mounted on said shaft and wherein said shaft is rotatably mounted on said frame means, a belt connecting said pulley and said drive wheel, and an external drive rotating said shaft.

* * * * *